US008928251B2

(12) United States Patent
Jeong

(10) Patent No.: US 8,928,251 B2
(45) Date of Patent: Jan. 6, 2015

(54) LIGHT EMITTING DIODE DRIVER

(71) Applicant: Jae Hong Jeong, Saratoga, CA (US)

(72) Inventor: Jae Hong Jeong, Saratoga, CA (US)

( * ) Notice: Subject to any disclaimer, the term of this patent is extended or adjusted under 35 U.S.C. 154(b) by 0 days.

(21) Appl. No.: 14/339,413

(22) Filed: Jul. 23, 2014

(65) Prior Publication Data

US 2014/0333220 A1 Nov. 13, 2014

Related U.S. Application Data

(62) Division of application No. 13/244,892, filed on Sep. 26, 2011.

(60) Provisional application No. 61/422,128, filed on Dec. 11, 2010.

(51) Int. Cl.
*G05F 1/00* (2006.01)

(52) U.S. Cl.
USPC ..... 315/291; 315/307; 315/185 S; 315/247; 315/312

(58) Field of Classification Search
USPC ..... 315/247, 185 S, 291, 307–325, 224
See application file for complete search history.

(56) References Cited

U.S. PATENT DOCUMENTS 7,439,944 B2 * 10/2008 Huynh et al. ..... 345/82
2014/0001978 A1 * 1/2014 Lee ..... 315/297
2014/0015424 A1 * 1/2014 Kraft ..... 315/185 R

* cited by examiner

*Primary Examiner* — Tuyet Thi Vo
(74) *Attorney, Agent, or Firm* — Patent Office of Dr. Chung Park

(57) ABSTRACT

A driver circuit for driving light emitting diodes (LEDs). The driver circuit includes a string of LEDs divided into n groups and the n groups of LEDs is electrically connected to each other in series, where a downstream end of group m−1 is electrically connected to the upstream end of group m. The driver circuit also includes a power source coupled to an upstream end of group 1 and provides an input voltage. The driver circuit further includes current regulating circuits, where each of the current regulating circuits is coupled to the downstream end of the corresponding group at one end and coupled to a ground at the other end. Each of the current regulating circuits includes a sensor amplifier and a cascode having first and second transistors. The driver circuit also includes detectors, where each of the detectors detects a source voltage of the first transistor.

12 Claims, 12 Drawing Sheets

LIGHT EMITTING DIODE DRIVER

CROSS REFERENCES

This application is a divisional application of U.S. patent application Ser. No. 13/244,892, filed Sep. 26, 2011, which claims the benefit of U.S. Provisional Applications No. 61/422,128, filed on Dec. 11, 2010, entitled "Light emitting diode driver using turn-on voltage of light emitting diode," and hereby incorporated by reference in its entirety.

BACKGROUND OF THE INVENTION

The present invention relates to a light emitting diode (LED) driver, and more particularly, to a circuit for driving a string of light emitting diode (LEDs).

Due to the concept of low energy consumption, LED lamps are prevailing and considered a practice for lighting in the era of energy shortage. Typically, an LED lamp includes a string of LEDs to provide the needed light output. The string of LEDs can be arranged either in parallel or in series or a combination of both. Regardless of the arrangement type, providing correct voltage and/or current is essential to efficient operation of the LEDs.

In application where the power source is periodic, the LED driver should be able to convert the time varying voltage to the correct voltage and/or current level. Typically, the voltage conversion is performed by circuitry commonly known as AC/DC converters. These converters, which employ an inductor or transformer, capacitor, and/or other components, are large in size and have short life, which results in an undesirable form factor in lamp design, high manufacturing cost, and reduction in system reliability. Accordingly, there is a need for an LED driver that is reliable and has a small form factor to thereby reduce the manufacturing cost.

SUMMARY OF THE INVENTION

In one embodiment of the present disclosure, a method for driving light emitting diodes (LEDs) includes: providing a string of LEDs divided into groups, the groups being electrically connected to each other in series; providing a power source electrically connected to the string of LEDs; coupling each of the groups to a ground through a corresponding one of current regulating circuits; turning off the current regulating circuits except the current regulating circuit corresponding to a most upstream one of the groups when an input voltage from the power source is at a voltage level of the ground; and increasing the input voltage from the power source to turn on the groups in a downstream sequence.

In another embodiment of the present disclosure, a driver circuit for driving light emitting diodes (LEDs) includes: a string of LEDs divided into n groups, the n groups of LEDs being electrically connected to each other in series, a downstream end of group m−1 being electrically connected to the upstream end of group m, where m being a positive number equal to or less than n; a power source coupled to an upstream end of group 1 and operative to provide an input voltage; a plurality of current regulating circuits, each of the current regulating circuits being coupled to the downstream end of a corresponding group at one end and coupled to a ground at an other end and including a sensor amplifier and a cascode having first and second transistors; and a plurality of detectors, each of the detectors being adapted to detect a source voltage of the first transistor.

In yet another embodiment of the present disclosure, a driver circuit for driving light emitting diodes (LEDs) includes: a string of LEDs divided into n groups, the n groups of LEDs being electrically connected to each other in series, a downstream end of group m−1 being electrically connected to the upstream end of group m, where m being a positive number equal to or less than n; a power source coupled to an upstream end of group 1 and operative to provide an input voltage; a plurality of current regulating circuits, each of the current regulating circuits being coupled to the downstream end of a corresponding group at one end and coupled to a ground at an other end and including a sensor amplifier and a cascode having first and second transistors; and a plurality of detectors, each of the detectors being adapted to detect a source voltage of the first transistor.

These and other features, aspects and advantages of the present invention will become better understood with reference to the following drawings, description and claims.

DETAILED DESCRIPTION OF THE INVENTION

Figure 1:
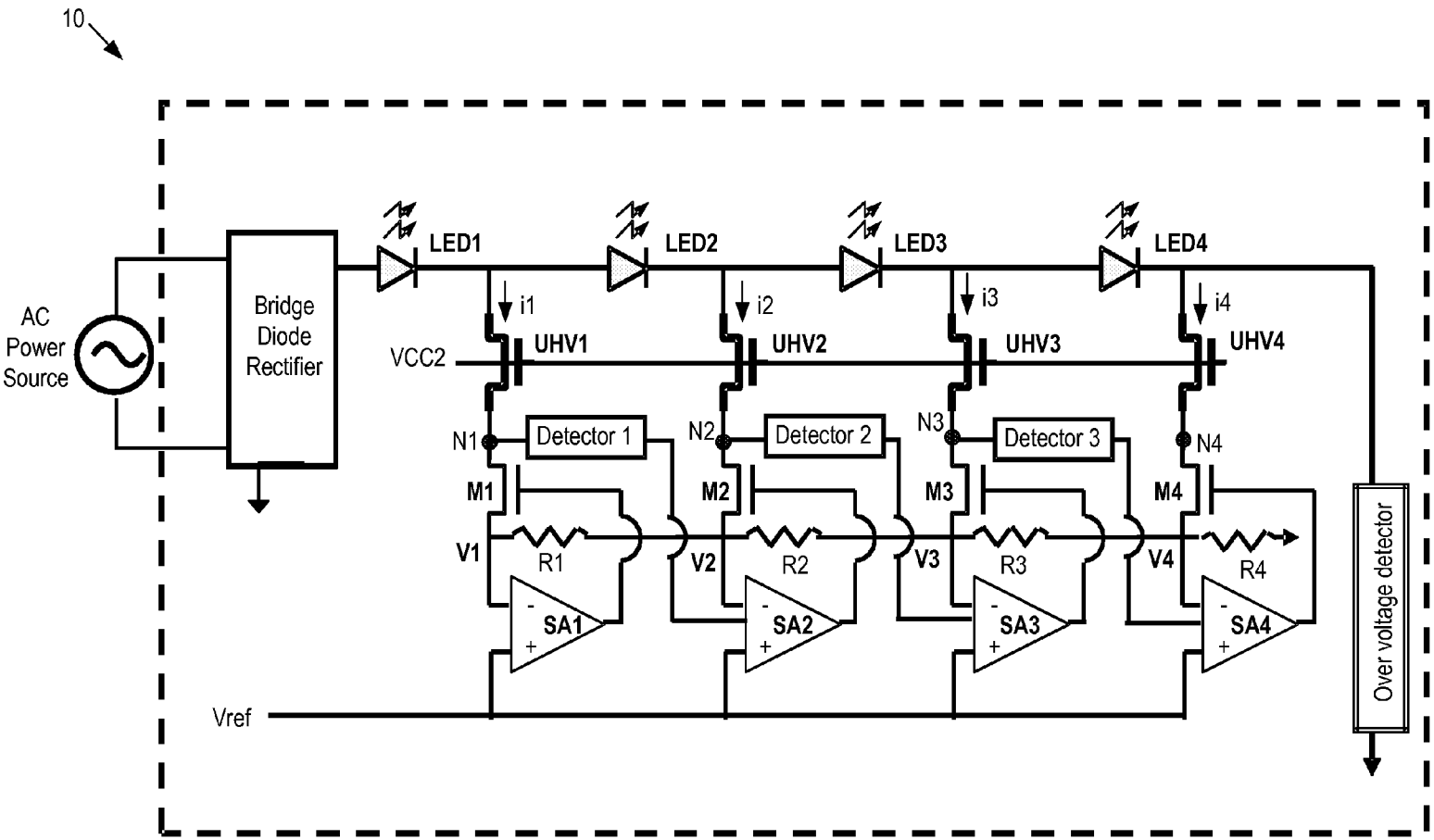
FIG. 1 shows a schematic diagram of an LED driver circuit in accordance with one embodiment of the present invention.

Referring now to FIG. 1, there is shown a schematic diagram of an LED driver circuit (or, shortly driver) 10 in accordance with one embodiment of the present invention. As depicted, the driver 10 is powered by a power source such as an alternative current (AC) power source. The electrical current from the AC power source is rectified by a rectifier circuit. The rectifier circuit can be any suitable rectifier circuit, such as bridge diode rectifier, capable of rectifying the alternating power from the AC power source. The rectified voltage Vrect is then applied to a string of light emitting diodes (LEDs). If desirable, the AC power source and the rectifier may be replaced by a direct current (DC) power source.

The LEDs as used herein is the general term for many different kinds of light emitting diodes, such as traditional LED, super-bright LED, high brightness LED, organic LED, etc. The drivers of the present invention are applicable to all kinds of LED.

As depicted in FIG. 1, a string of LEDs is electrically connected to the power source and divided into four groups. However, it should be apparent to those of ordinary skill in the art that the string of LEDs may be divided into any suitable number of groups. The LEDs in each group may be a combination of the same or different kind, such as different color. They can be connected in serial or parallel or a mixture of both. Also, one or more resistances may be included in each group.

A separate current regulating circuit (or, shortly regulating circuit) is connected to the downstream end of each LED group, where the current regulating circuit collectively refers to a group of elements for regulating the current flow, say i1, and includes a first transistor (say, UHV1), a second transistor (say, M1), and a sensor amplifier (say, SA1). Hereinafter, the term transistor refers to an N-Channel MOSFET, a P-Channel MOSFET, an NPN-bipolar transistor, a PNP-bipolar transistor, an Insulated gate Bipolar Transistor (IGBT), analog switch, or a relay.

The first and second transistors are electrically connected in series, forming a cascode structure. The first transistor is capable of shielding the second transistor from high voltages. As such, the first transistor is referred as shielding transistor hereinafter, even though its function is not limited to shielding the second transistor. The main function of the second transistor includes regulating the current i1, and as such, the second transistor is referred as regulating transistor hereinafter. The shielding transistor may be an ultra-high-voltage (UHV) transistor that has a high breakdown voltage of 500 V, for instance, while the regulating transistor M1 may be a low-voltage (LV), medium-voltage (MV), or a high-voltage (HV) transistor and has a lower breakdown voltage than the shielding transistor. The node, such as N1, refers to the point where the source of the shielding transistor is connected to the drain of the regulating transistor.

The sensor amplifier SA1, which may be an operational amplifier, compares the voltage V1 with the reference voltage Vref, and outputs a signal that is input to the gate of the regulating transistor, to thereby form a feedback control of the current i1 flowing through the cascode and the current sensing resistors R1, R2, R3, and R4. The gate voltage of the shielding transistor may be set to a constant voltage, Vcc2. (Hereinafter, Vcc2 refers to a constant voltage.) The mechanism for generating the constant gate voltage Vcc2 is well known in the art, and as such, the detailed description of the mechanism is not described in the present document.

As discussed above, each current regulating circuit is electrically connected to the downstream end of the corresponding LED group at one end and to the ground at the other end via the current sensing resistors. The voltages V1, V2, V3, and V4 represent the electrical potentials at the downstream ends of the regulating transistors M1, M2, M3, and M4, respectively. Thus, for instance, the voltage V1 can be represented by the equation:

$$V1=i1*(R1+R2+R3+R4)+i2*(R2+R3+R4)+i3*(R3+R4)+i4*R4.$$

The driver 10 can turn on/off each group of LEDs successively as the level of Vrect changes. As the voltage of the power source starts increasing from zero, Vrect may not be high enough to cause the electrical current to flow through the LEDs. The detector 1, detector 2, and detector 3 continuously monitor the voltage levels at nodes N1, N2, and N3. When the voltage levels at each node, say N1, is lower than a preset threshold level, the detector 1 sends its output signal to the sensor amplifier SA2 so that the sensor amplifier SA2 is disabled and, as a consequence, the regulating transistor M2 is turned off. V1 is lower than the reference voltage Vref, and thus, the sensor amplifier SA1 is enabled. Also, the enabled sensor amplifier SA1 outputs an output signal in the high-state to turn on the regulating transistor M1. More specifically, the output pin of the sensor amplifier SA1 is directly connected to the gate of the regulating transistor M1, and the high-state output signal turns on the regulating transistor M1. Thus, in this early stage, only the first regulating transistor M1 is turned on and, thus, only the first current regulating circuit conducts the current, while the other current regulating circuits are turned off.

As Vrect increases, the current i1 flows through the first group LED1, causing LED1 to emit light. Then, the current i1 flows through the transistors UHV1, M1 and the current sensing resistors R1, R2, R3, and R4 to the ground. When the voltage level at the node N1 reaches a preset level, the detector 1 sends an output signal to the sensor amplifier SA2 so that the sensor amplifier SA2 turns on the regulating transistor M2 and the current i2 flows through LED2. Thus, in this stage, both current i1 and i2 flows through LED1 and LED2, respectively.

As Vrect further increases to the level where the voltage V1 is higher than Vref, the sensor amplifier SA1 sends a low-state output signal to the regulating transistor M1 to thereby turn off the regulating transistor M1. In this stage, only the current i2 flows through LED1 and LED2. When the current i1 is cut off (or, set to a minimal level), the overall efficiency of the driver 10 increases. It is because LED2 would produce more light if more current flows therethough, and, cutting off (or reducing) the current i1 would cause the current i1 to be redirected to LED2.

The same analogy applies to other current regulating circuits corresponding to Groups 2-4. For example, the current regulating circuit for LED3 is turned off until the detector 2 sends a high-state output signal to the sensor amplifier SA3. Also, the current regulating circuit for LED3 is turned off when V3 is higher than Vref.

When the source voltage (or the rectified voltage Vrect) reaches its peak, the current regulating circuits for LED1, LED2, and LED3 are turned off. As Vrect starts descending, the above process reverses so that the first current regulating circuit turns back on last. The similar operational sequences (i.e., the sequences of turning on/off) of the current regulating circuits as Vrect varies apply to all of the embodiments of the present document.

As discussed above, each regulating circuit includes two transistors, such as UHV1 and M1, arranged in series to form a cascode structure. The cascode structure, which is implemented as a current sink, has various advantages compared to a single transistor current sink. First, it has enhanced current driving capability. When operating in its saturation region, which is desired for a current sink, the current driving capability (Idrv) of an LV/MV/HV NMOS is far superior to an UHV NMOS. For example, Idrv of a typical LV NMOS is 500 μA/μm whereas that of a typical UHV NMOS is 10-20 μA/μm. Thus, to regulate the same amount of current flow, the required projection area of an UHV NMOS on the chip is at least 20 times as large as that of an LV NMOS. Also, a typical UHV NMOS has the minimum channel length of 20 μm, while a typical LV NMOS has the minimum channel length of 0.5 μm. However, a typical LV NMOS requires a shielding mechanism that offers protection from high voltages. In the cascode structure, the first transistor, preferably UHV NMOS, operates as a shielding transistor, while the second transistor, preferably LV/MV/HV NMOS, operates as a current regulator, providing enhanced current driving capability. The shielding transistor is not operating in saturation region as would be in the case where a single UHV NMOS is used as the current sink and operated in the linear region. As such, the current driving capability Idrv is not the determinative design factor; rather the resistance of the shielding transistor, Rdson, is the important factor in designing the UHV NMOS of the cascode.

Second, due to the series configuration of the cascode structure, the required voltage (a.k.a. voltage compliance or voltage headroom) of the cascode structure can be higher than a single UHV NMOS configuration. For an LED driver case, however, the power loss due to the required voltage is much less than the power loss due to the LED driving voltage. For example, in an AC-driven LED driver case, the LED driving voltage (voltage on the LED anode) ranges 100 Vmrs~250 Vrms. Assume the required voltage of a single UHV NMOS is 2V whereas that of a cascode structure is 5V. In this case, the efficiencies are 98~99% and 95~98%, respectively. Of course, Rdson can be reduced so that the required voltage of the cascode structure can be about the same as that of a single UHV NMOS. The point is that the additional power consumed by the cascode structure is a minor disadvantage. If efficiency is a crucial design factor, the cascode structure can be designed in a current mirror configuration whereas a current mirror configuration using two UHV NMOS transistors is not practically feasible due to their large area on the chip.

Third, turning on/off the current sink is easier in the cascode structure since the UHV MOS and LV/MV/HV NMOS are controlled separately. In a single UHV NMOS current sink, both current regulation and on/off action have to be done by controlling the gate of the UHV NMOS, which has the characteristics of a large capacitor. In contrast, in the cascode structure, the current regulation can be done by controlling the LV/MV/HV NMOS and on/off action can be done by controlling the UHV NMOS that requires only logic operation applied on the gate.

Fourth, the speed of turning on/off is controlled more smoothly in the cascode structure than a single UHV NMOS configuration. In a single UHV NMOS configuration, the linear control of current cannot be easily achieved by controlling the gate voltage since the current is a square function of the gate voltage. By contrast, in a cascode structure, when the gate of the LV/MV/HV NMOS is controlled, the current control (slewing) becomes smoother since it is operating as a resistor that is an inverse function of the gate voltage.

Fifth, the cascode structure provides better noise immunity. Noise from the power supply can propagate through the LEDs and subsequently can be coupled to the current regulating circuit. More specifically, the noise is introduced into the feedback loop of the current regulating circuit. In a single UHV NMOS configuration, this noise is directly coupled to this loop, whereas, in a cascode structure, the noise is attenuated by the ratio of Rdson of the UHV NMOS to the effective resistance of the LV/MV/HV NMOS.

Sixth, the noise generated by a cascode structure is lower than a single UHV NMOS configuration. In the cascode structure, the current control is mainly performed by the regulating transistor, while, in a single UHV NMOS configuration, the current control is performed by the UHV NMOS. Since the gate capacitance of the LV/MV/HV NMOS is lower than the UHV NMOS, the noise generated by the cascode structure is lower than a single UHV NMOS configuration.

It is noted that the shielding transistors UHV1~UHV4 may be identical or different from each other. Likewise, the regulating transistors M1~M4 may be identical or different from each other. The specifications of the shielding and regulating transistors may be selected to meet the designer's objectives.

Figure 2:
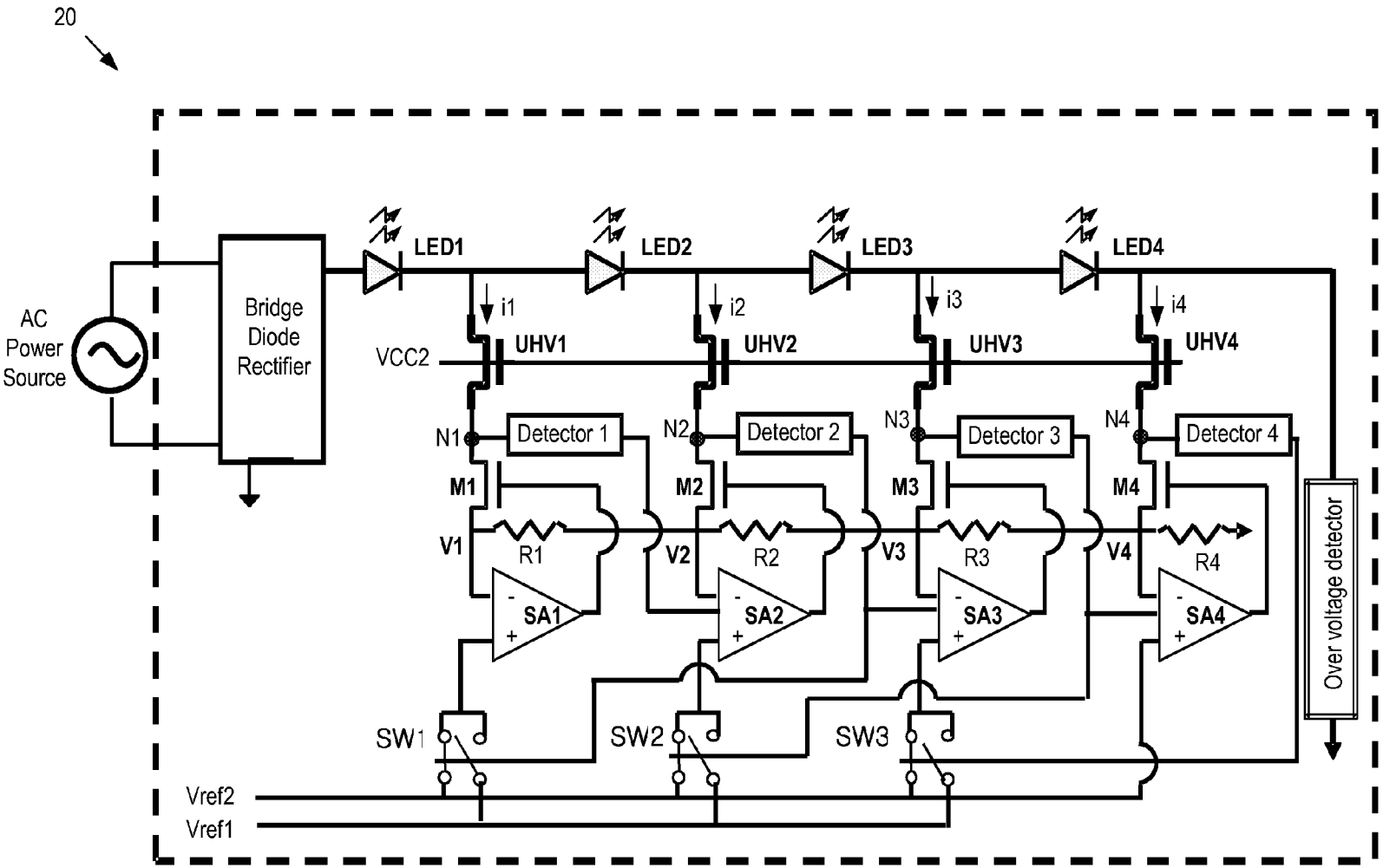
FIG. 2 shows a schematic diagram of an LED driver circuit in accordance with another embodiment of the present invention.

FIG. 2 shows a schematic diagram of an LED driver circuit 20 in accordance with another embodiment of the present invention. As depicted, the driver circuit 20 is similar to the driver circuit 10, the difference being that each of the output signals of the detector 1~detector 3 is used to determine the reference voltage of the sensor amplifier of the upstream group. For example, the first reference voltage Vref1 is lower than the second reference voltage Vref2. When the voltage level at the node N2 reaches a preset level, the detector 2 sends a signal to the switch SW1 so that the reference voltage is switched from Vref2 to Vref1. Then, the output signal of the sensor amplifier SA1 is changed from high-state to low-state to thereby turn off the regulating transistor M1.

Figure 3:
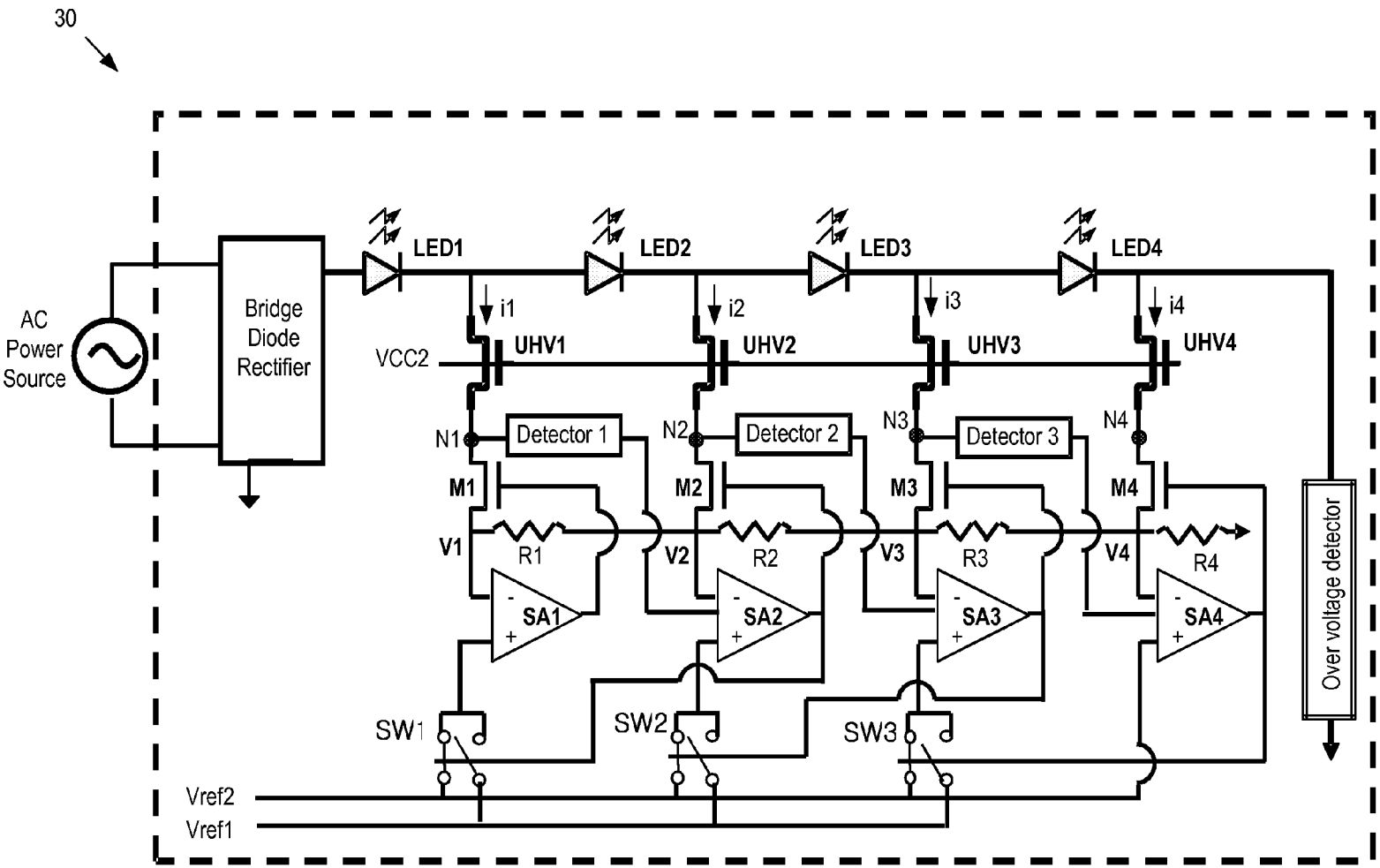
FIG. 3 shows a schematic diagram of an LED driver circuit in accordance with another embodiment of the present invention.

FIG. 3 shows a schematic diagram of an LED driver circuit 30 in accordance with another embodiment of the present invention. As depicted, the driver circuit 30 is similar to the driver circuit 20, the difference being that the output signal of a sensor amplifier, say SA2, is input to a switch, say SW1, of the upstream group. The switch SW1 flips between two reference voltages Vref1 and Vref2 to provide a proper reference voltage to the sensor amplifier SA1 according to the output signal of the sensor amplifier SA2. For example, Vref2 is higher than Vref1. Then, when the voltage V2 reaches a preset level and/or the voltage level at Node 2 reaches a preset level, the sensor amplifier SA2 sends a signal to the switch SW1, and subsequently, the switch SW1 switches from Vref2 to Vref1 so that the sensor amplifier SA1 cuts off the regulating transistor M1.

Figure 4:
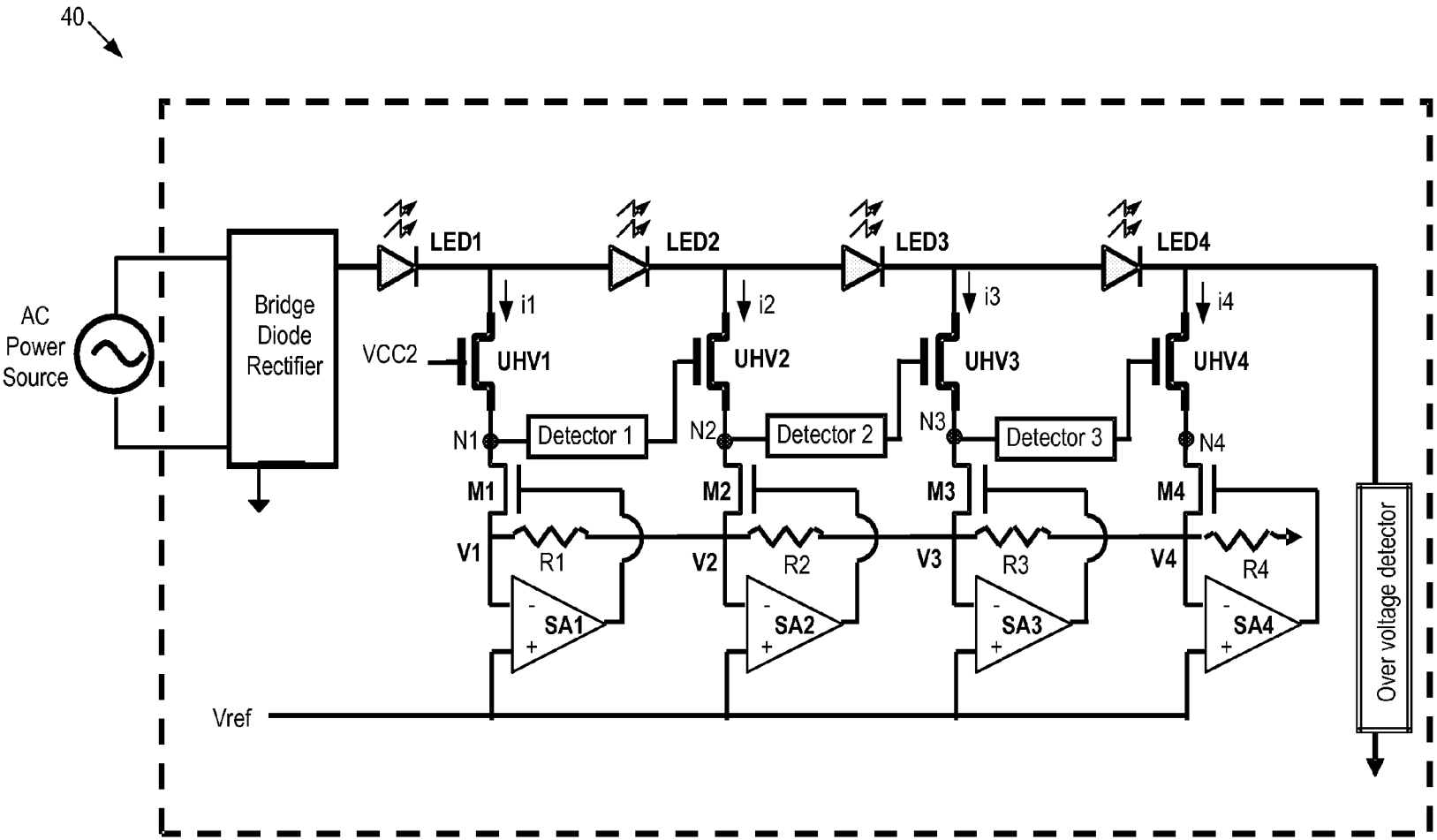
FIG. 4 shows a schematic diagram of an LED driver circuit in accordance with another embodiment of the present invention.

FIG. 4 shows a schematic diagram of an LED driver circuit 40 in accordance with another embodiment of the present invention. As depicted, the driver circuit 40 is similar to the driver circuit 10 in FIG. 1, the difference being that the output pin of each of the detectors is directly connected to the gate of the shielding transistor of the next downstream current regulating circuit. Each detector sends an output signal to the gate of the first (or, shielding) transistor associated with the next downstream LED group to thereby control the current flowing through the current regulating circuit. For instance, the shielding transistors UHV2, UHV3, and UHV4 are turned off and UHV1 is turned on when Vrect is at the ground level. As Vrect increases and the voltage at the node N1, which is monitored by the detector 1, reaches a preset level, the detector 1 sends an output signal to the gate of the shielding transistor UHV2 to thereby turn on UHV2. Thus, in this stage, both current i1 and i2 flows through LED1 and LED2, respectively.

As Vrect further increases to the level where the voltage V1 is higher than Vref, the sensor amplifier SA1 sends a low-state output signal to the regulating transistor M1 to thereby turn off the regulating transistor M1. In this stage, only the current i2 flows through LED1 and LED2. The same analogy applies to the other current regulating circuits. It is noted that the gate voltage of UHV1 is maintained at the constant level Vcc2 so that it is turned on when Vrect is at the ground level.

Figure 5:
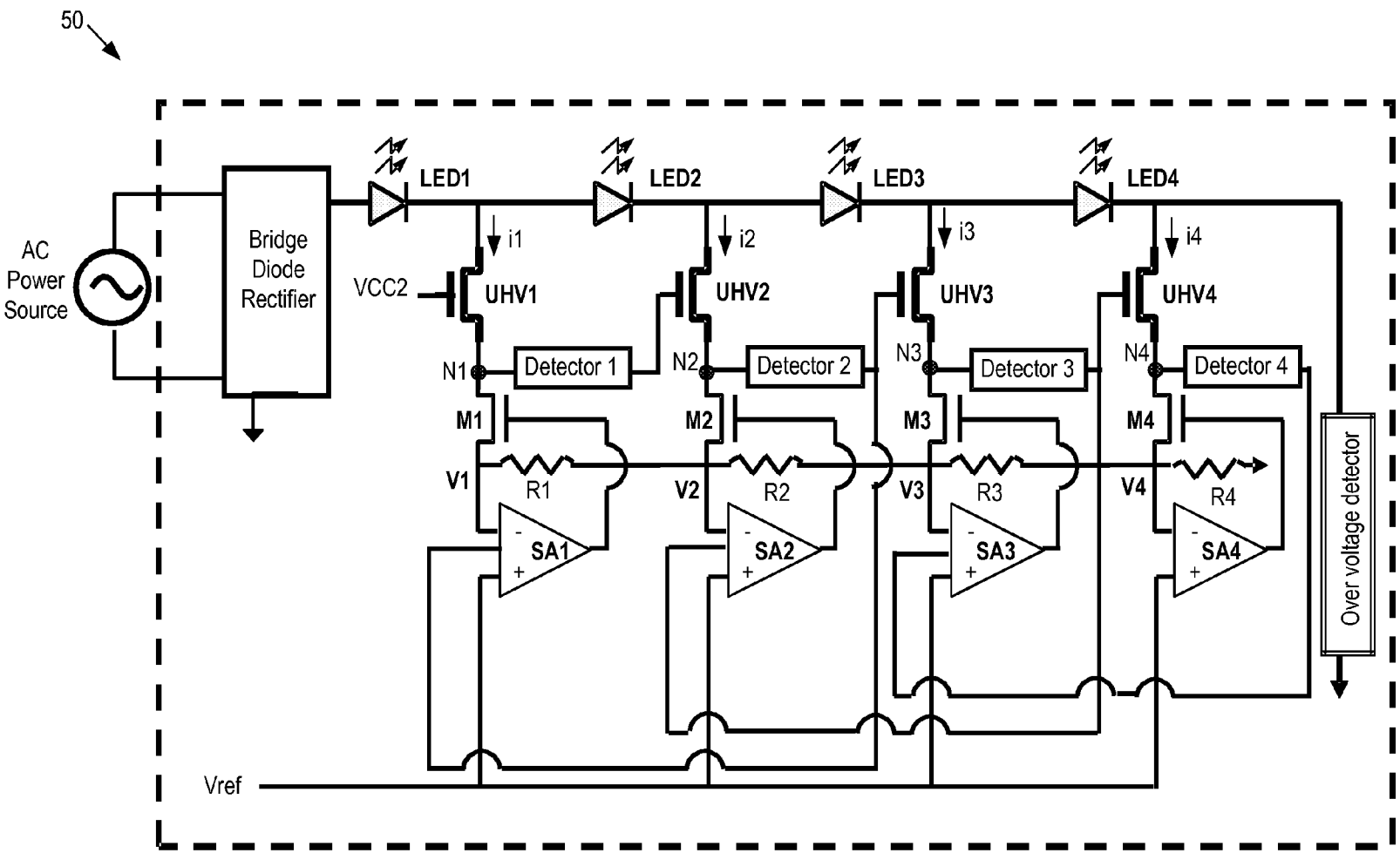
FIG. 5 shows a schematic diagram of an LED driver circuit in accordance with another embodiment of the present invention.

FIG. 5 shows a schematic diagram of an LED driver circuit 50 in accordance with another embodiment of the present invention. As depicted, the driver circuit 50 is similar to the driver circuit 40 in FIG. 4, the difference being that the output pin of each of the detectors is also directly connected to the sensor amplifier of the upstream current regulating circuit, to thereby control the current flowing through the upstream current regulating circuit. For instance, when the voltage at the node N2, which is monitored by the detector 2, reaches a preset level, the detector 2 sends an output signal to the sensor amplifier SA1. Then, the sensor amplifier SA1 sends an output signal to the gate of the regulating transistor M1 to thereby turn off the current i1. The same analogy applies to the detector 3 and detector 4. It is noted that the gate of the first shielding transistor UHV1 is maintained at a constant level so that the current regulating circuit of LED1 is turned on when Vrect is at the ground level.

Figure 6:
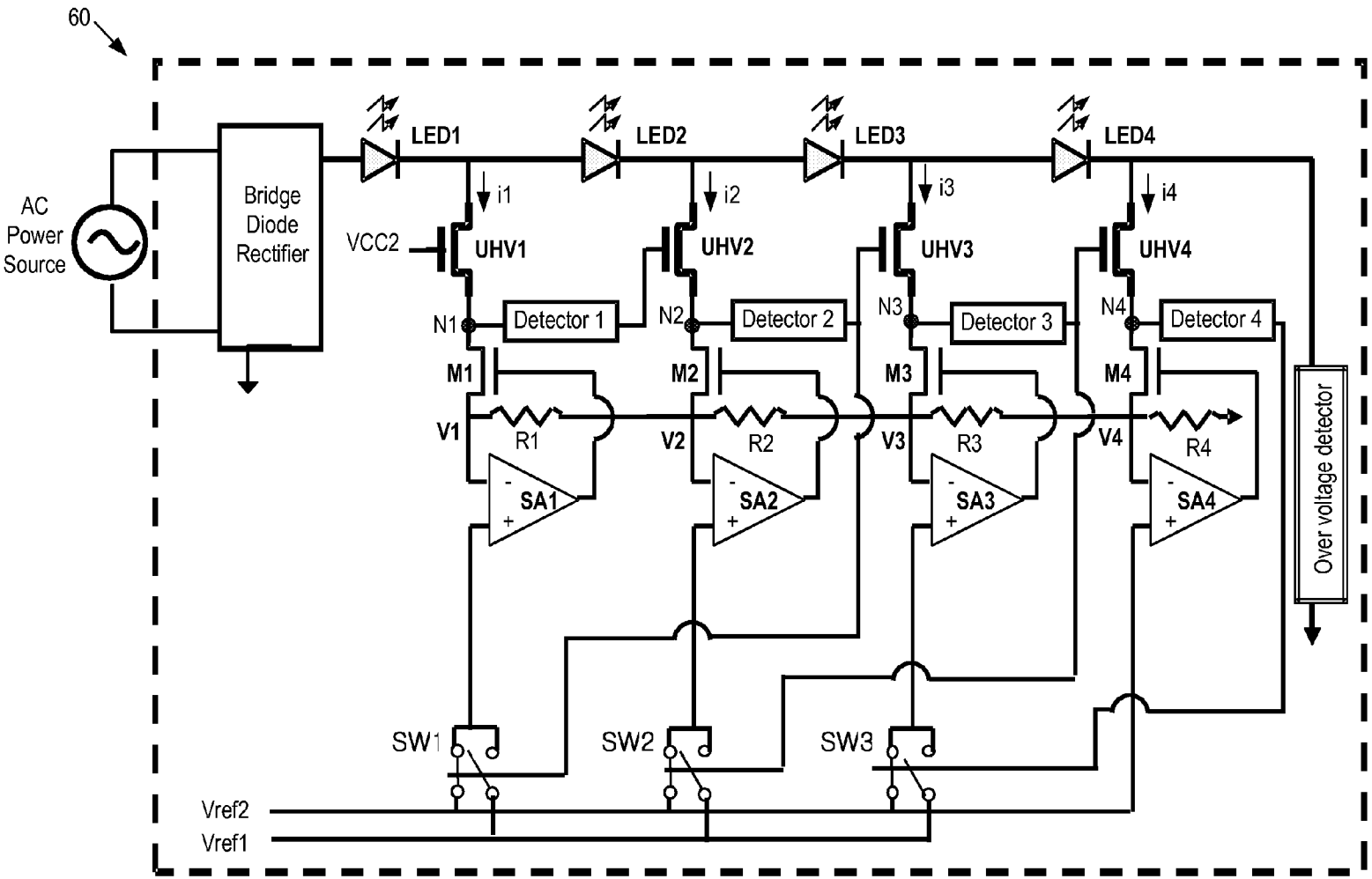
FIG. 6 shows a schematic diagram of an LED driver circuit in accordance with another embodiment of the present invention.

FIG. 6 shows a schematic diagram of an LED driver circuit 60 in accordance with another embodiment of the present invention. As depicted, the driver circuit 60 is similar to the driver circuit 40 in FIG. 4, the difference being that the output pin of each of the detectors is also directly connected to the switch of the upstream current regulating circuit, to thereby control the current flowing through the upstream current regulating circuit. For instance, when the voltage at the node N2, which is monitored by the detector 2, reaches a preset level, the detector 2 sends an output signal to the switch SW1. Then, assuming that Vref2 is higher than Vref1, the switch SW1 flips from Vref2 to Vref1 so that Vref1 is input to the sensor amplifier SA1. Subsequently, the sensor amplifier SA1 sends an output signal to the gate of the regulating transistor M1 to cut off the current i1. The same analogy applies to other detectors. It is noted that the gate of the first shielding transistor UHV1 is maintained at a constant level so that the current regulating circuit of LED1 is turned on when Vrect is at the ground level.

Figure 7:
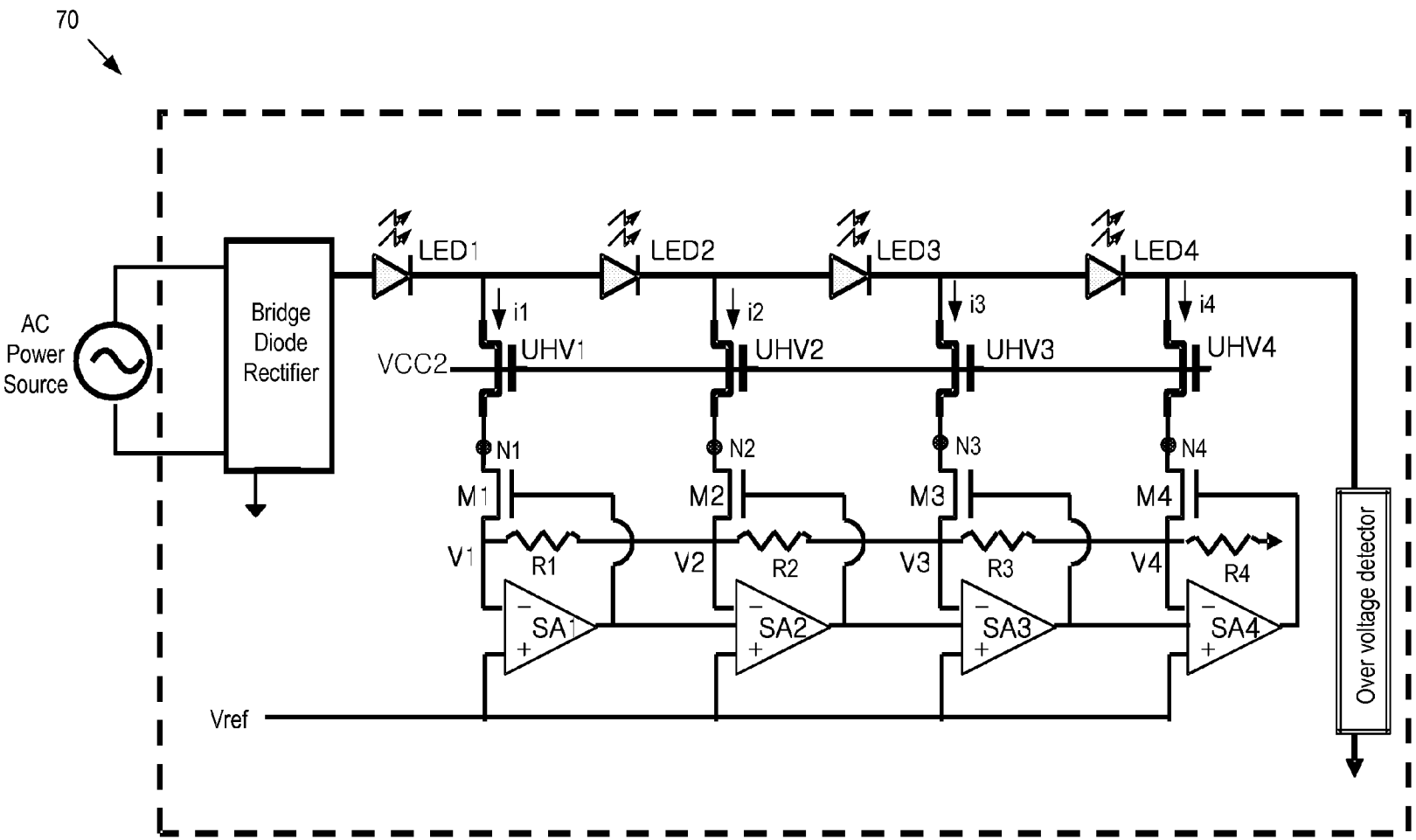
FIG. 7 shows a schematic diagram of an LED driver circuit in accordance with another embodiment of the present invention.

FIG. 7 shows a schematic diagram of an LED driver circuit 70 in accordance with another embodiment of the present invention. As depicted, the driver circuit 70 is similar to the driver circuit 10, with the differences that the driver 70 does not include detectors and that the output signal of a sensor amplifier, say SA1, is input to the downstream sensor amplifier, say SA2. For example, the current regulating circuits of LED2, LED3, and LED4 are turned off when Vrect is at the ground level. As the voltage V1 reaches a preset level, the sensor amplifier SA1 sends an output signal to the sensor amplifier SA2 so that the sensor amplifier SA2 turns on the regulating transistor M2, allowing the current i2 to flow through LED2. Thus, in this stage, both current i1 and i2 flows through LED1 and LED2, respectively.

As Vrect further increases to the level where the voltage V1 is higher than Vref, the sensor amplifier SA1 sends a low-state output signal to the regulating transistor M1 to thereby turn off the regulating transistor M1. In this stage, only the current i2 flows through LED1 and LED2.

The same analogy applies to other current regulating circuits corresponding to Groups 2-4. For example, the current regulating circuit for LED3 remains in the disabled state until the sensor amplifier SA2 sends a high-state output signal to the sensor amplifier SA3. Also, the current regulating circuit for LED3 is turned off (or, disabled) when V3 is higher than Vref.

Figure 8:
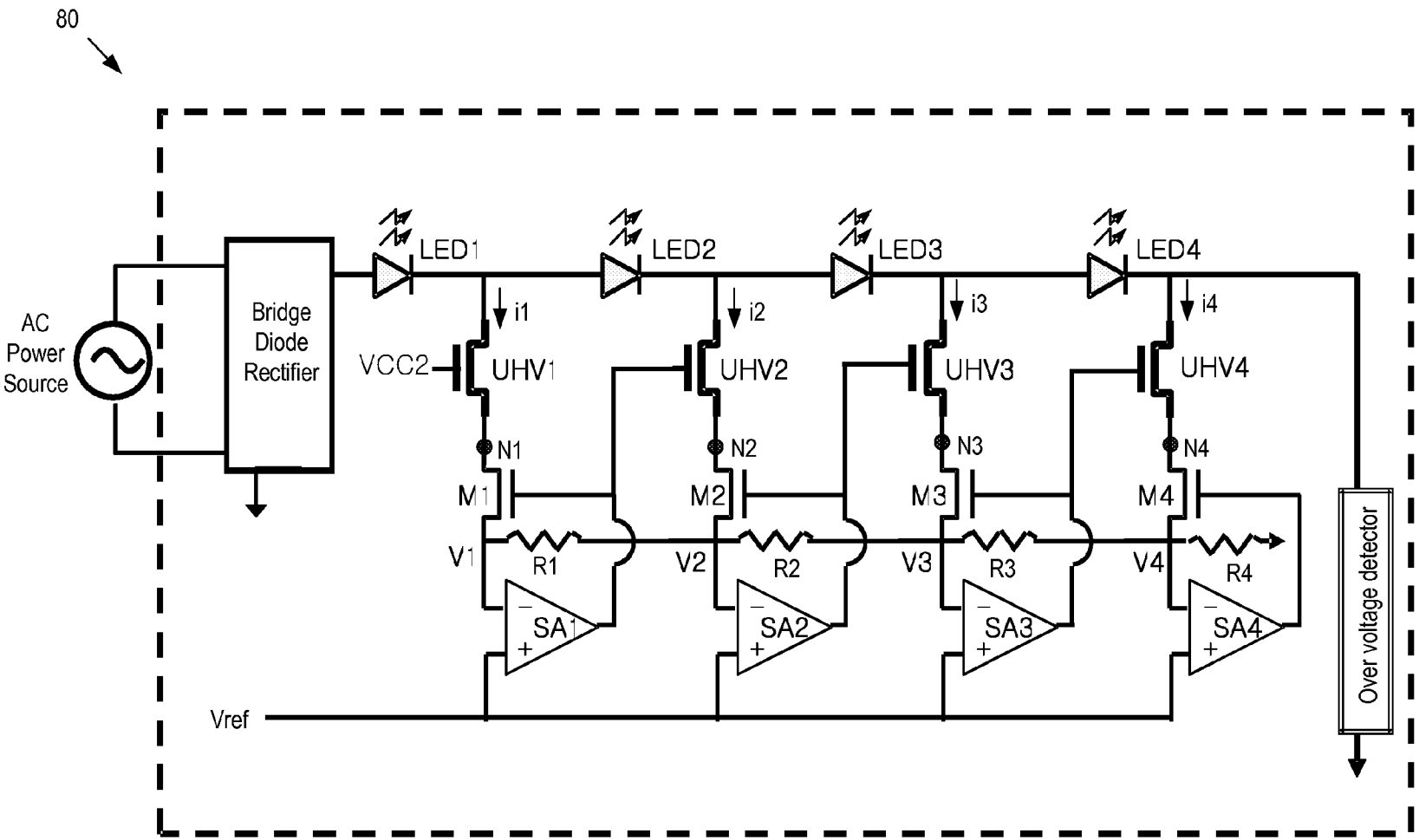
FIG. 8 shows a schematic diagram of an LED driver circuit in accordance with another embodiment of the present invention.

FIG. 8 shows a schematic diagram of an LED driver circuit 80 in accordance with another embodiment of the present invention. As depicted, the driver circuit 80 is similar to the driver circuit 70 in FIG. 7, the difference being that the output pin of each sensor amplifier is connected to the gate of the shielding transistor of the downstream current regulating circuit, to thereby control the current flowing through the downstream current regulating circuit. For instance, the shielding transistors UHV2, UHV2, and UHV3 are turned off and UHV1 is turned on when Vrect is at the ground level. As the voltage V1 increases to a preset level, the sensor amplifier SA1 sends an output signal to the gate of the shielding transistor UHV2 to thereby turn on the transistor UHV2. The same analogy applies to other current regulating circuits. It is noted that the gate of the first shielding transistor UHV1 is maintained at a constant level so that the current regulating circuit of LED1 is turned on when Vrect is at the ground level.

Figure 9:
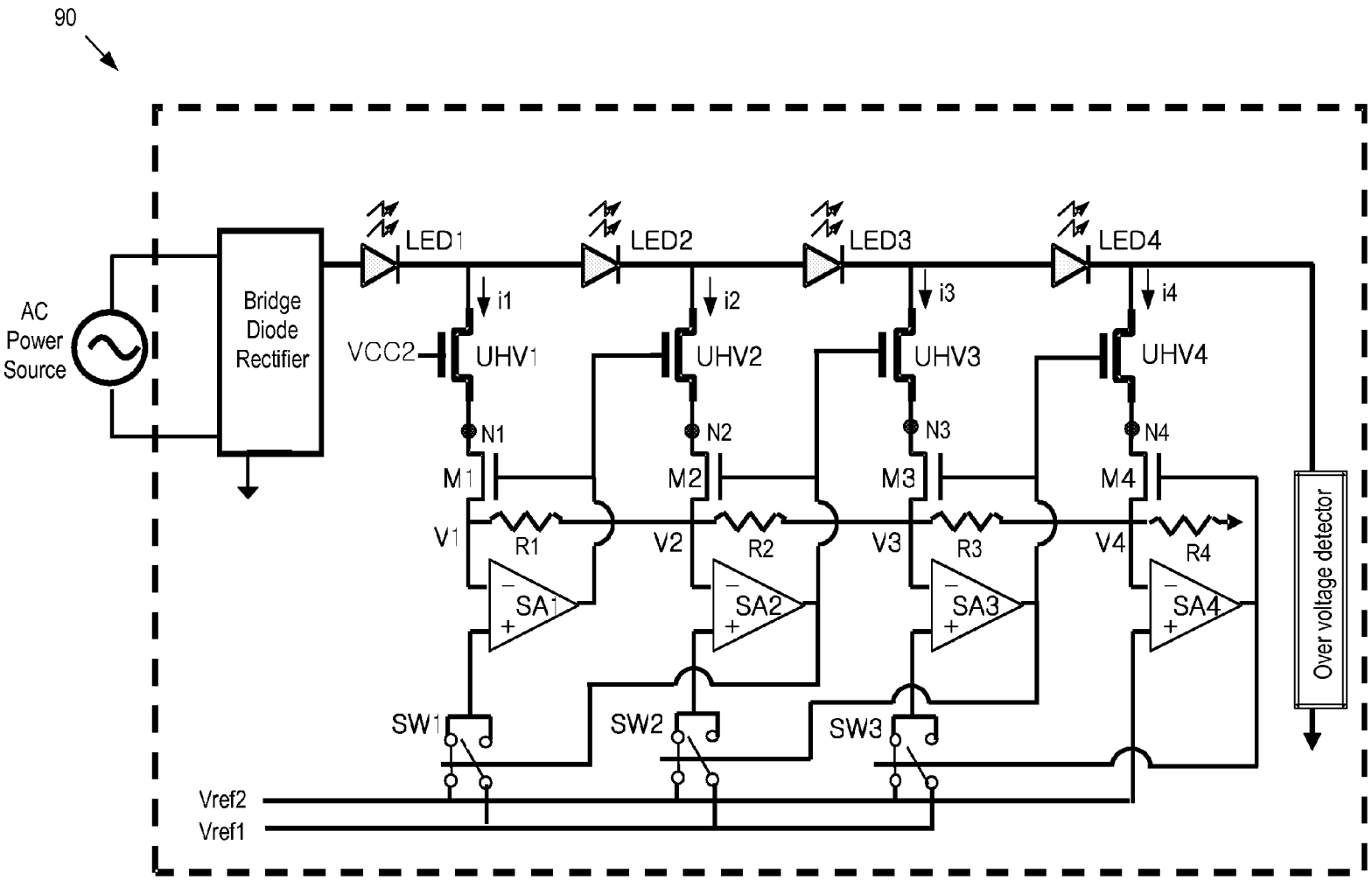
FIG. 9 shows a schematic diagram of an LED driver circuit in accordance with another embodiment of the present invention.

FIG. 9 shows a schematic diagram of an LED driver circuit 90 in accordance with another embodiment of the present invention. As depicted, the driver circuit 90 is similar to the driver circuit 80 in FIG. 8, the difference being that the output pin of each sensor amplifier is also connected to the switch of the upstream current regulating circuit, to thereby control the current flowing through the upstream current regulating circuit. For instance, as the voltage V2 increases to a preset level, the sensor amplifier SA2 sends an output signal to the switch SW1. Then, assuming that Vref2 is higher than Vref1, the switch SW1 flips from Vref2 to Vref1 so that Vref1 is input to the sensor amplifier SA1. Subsequently, the sensor amplifier SA1 sends an output signal to the gate of the regulating transistor M1 to cut off the current i1. The same analogy applies to other current regulating circuits. It is noted that the gate of the first shielding transistor UHV1 is maintained at a constant level Vcc2 so that the current regulating circuit of LED1 is turned on when Vrect is at the ground level.

Figure 10A:
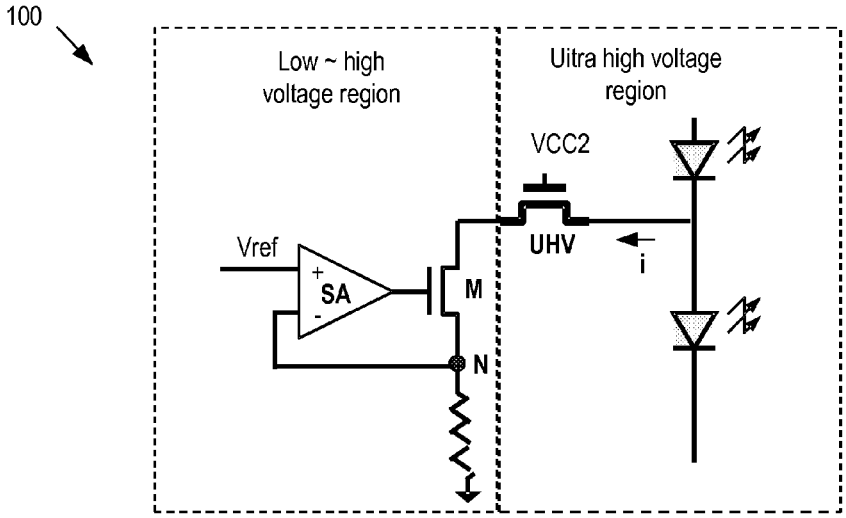
FIG. 10A-10C show schematic diagrams of circuits for controlling the current flowing through a transistor in accordance with another embodiment of the present invention.

FIG. 10A shows a schematic diagram of a circuit 100 for controlling the current i flowing through a regulating transistor M, where the circuit 100 may be included in the driver circuits 10~90. As depicted, the sensor amplifier SA compares the reference voltage Vref to the voltage level at the node N and sends an output signal to the gate of the regulating transistor M to thereby control the current i. The types and operational mechanisms of the components of the circuit 100 are described in conjunction with FIG. 1. For example, the regulating transistor M can be LV/MV/HV NMOS, while the shielding transistor can be UHV NMOS. For brevity, the description of other components is not repeated.

Figure 10B:
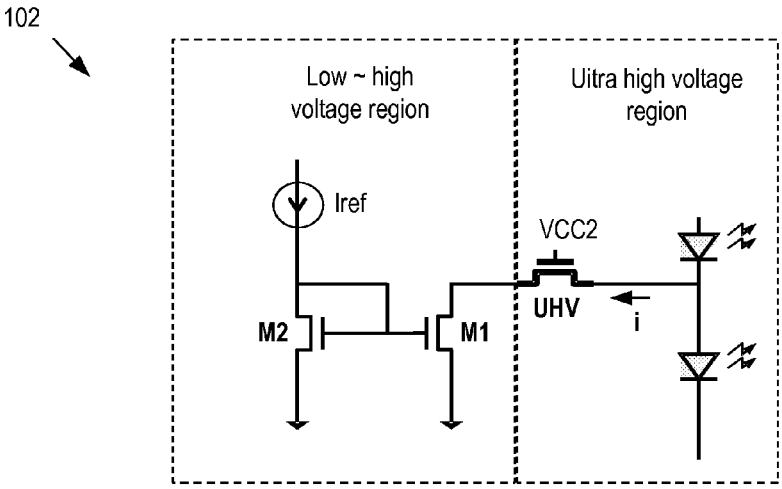

FIG. 10B shows a schematic diagram of a circuit 102 for controlling the current i flowing through a regulating transistor M1 in accordance with another embodiment of the present invention. As depicted, another transistor M2, which is identical to the regulating transistor M1, is connected to the regulating transistor M1 to form a current mirror configuration. More specifically, the gates of the two transistors M1, M2 are electrically connected to each other to have the same gate voltage. The current Iref flowing through the second transistor M2 is controlled to regulate the current i flowing through the regulating transistor M1. The current regulating circuit 102 may be used in place of the current regulating circuit 100 of FIG. 10A, and as such, the current regulating circuit 102 may be used in the driver circuits of FIGS. 1-9. Furthermore, the current Iref may be varied from one level to another to have the effect of switching the reference voltage from Vref1 to Vref2 in the driver circuits 20, 30, 60 and 90.

It is noted that only two reference voltages Vref1 and Vref2 are used for each switch of the driver circuits 20, 30, 60 and 90. However, it should be apparent to those of ordinary skill in the art that more than two references voltages may be used for each switch.

Figure 10C:
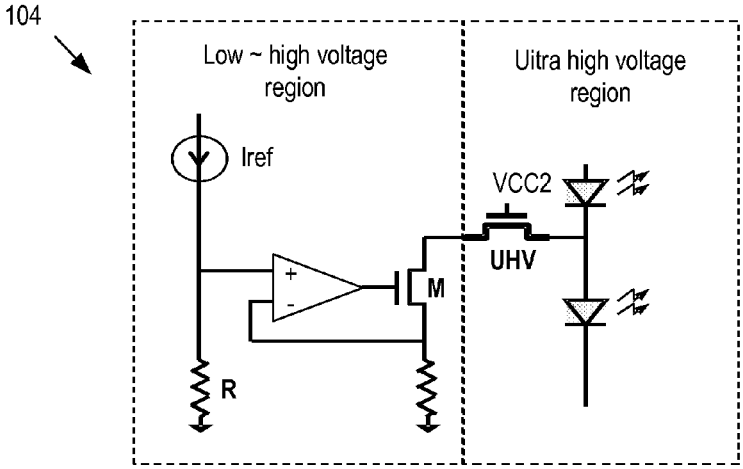

FIG. 10C shows a schematic diagram of a circuit 104 for controlling the current i flowing through a regulating transistor M in accordance with another embodiment of the present invention. As depicted, the sensor amplifier SA is provided with a non-inverting input voltage Vref, where Vref is determined by the equation:

$$Vref = Iref * R,$$

where Iref and R represent current and resistor, respectively.

The current regulating circuit 104 may be used in place of the current regulating circuit 100 of FIG. 10A. As such, the current regulating circuit 104 may be used in the driver circuits of FIGS. 1-9. Furthermore, the current Iref may be changed from one level to another to have the effect of switching the reference voltage from Vref1 to Vref2 in the driver circuits 20, 30, 60 and 90.

Figure 11:
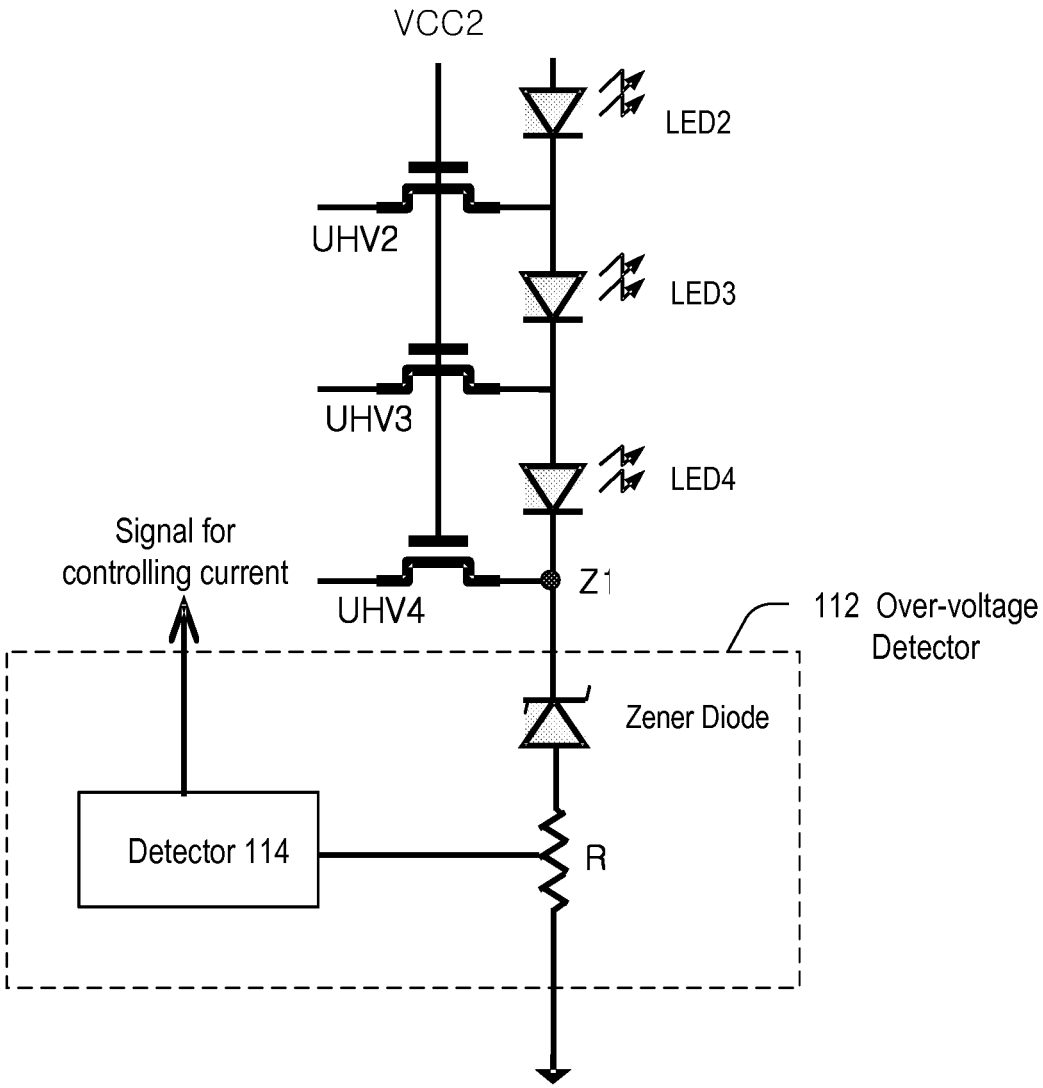
FIG. 11 shows a schematic diagram of an over-voltage detector in accordance with another embodiment of the present invention.

FIG. 11 shows a schematic diagram of an over-voltage detector 112 in accordance with another embodiment of the present invention. As depicted, the over-voltage detector 112 may include: a Zener diode connected to the downstream end of the last LED group; a detector 114 for detecting voltage; and a sensing resistor R. The voltage level at the node Z1 equals the voltage difference between Vrect and the voltage drop by the string of LEDs. When the voltage level at Z1 exceeds a preset level, which is preferably the breakdown voltage of the Zener diode, the current flows through the sensing resistor R. Then, a detector 114 detects the voltage level at a point of the resistor R and sends a signal to a proper component of the driver circuit to thereby control the current flowing through the LEDs, i.e., to cut off the current flowing through the LEDs or to prevent the excess power dissipation in the chip that contains the driver circuits. For example, the output signal of the over-voltage detector 112 is input to the SA4 in FIG. 1 so that the current i4 is cut off. In another example, the output signal is sent to a component (not shown in FIG. 1) that generates the reference voltage Vref so that the component may reduce the Vref in FIG. 1. In still another example, the output signal is used to lower the gate voltage Vcc2 of the shielding transistors UHVs. It is noted that the over-voltage detector 112 may be also used in the driver circuits of FIGS. 1-9.

Figure 12A:
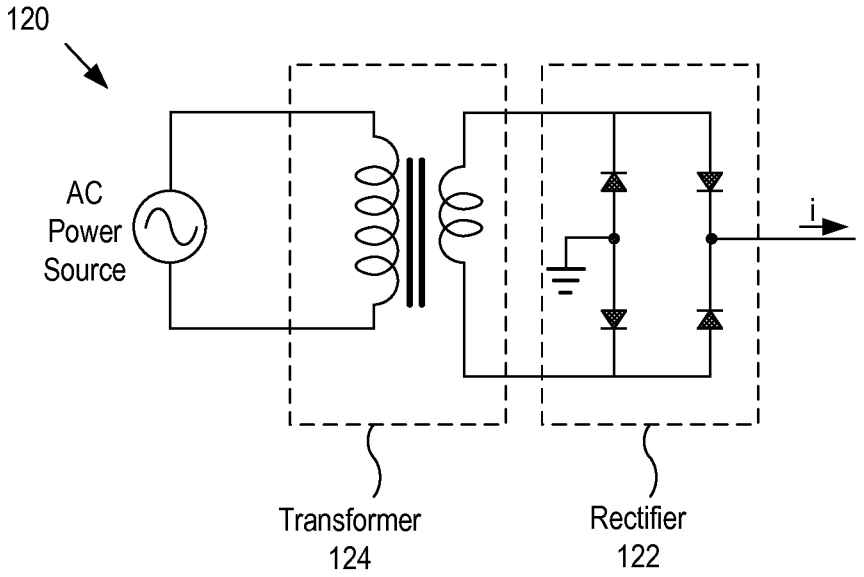
FIGS. 12A-12B show schematic diagrams of input power generators in accordance with another embodiment of the present invention.
Figure 12B:
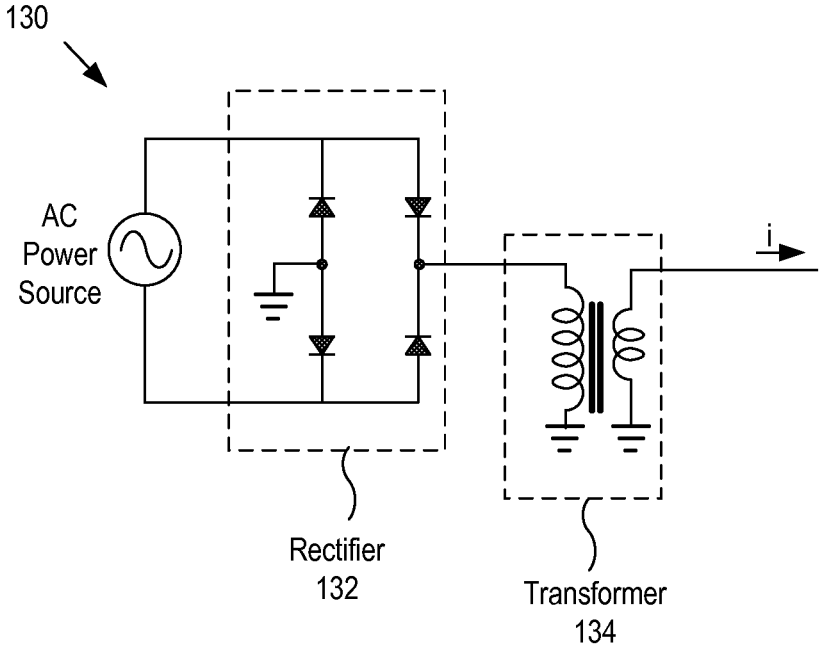

As depicted in FIGS. 1-9, each driver may include a rectifier to rectify the current supplied by an AC power source. In certain applications, such as high power LED street lights, the LEDs may demand high power consumption. In such applications, the driver may be isolated from the AC power source by a transformer for safety purposes. FIGS. 12A-12B show schematic diagrams of input power generators 120 and 130 in accordance with another embodiment of the present invention. As depicted in FIG. 12A, a transformer 124 may be disposed between AC input and the rectifier 122. Alternatively, a rectifier 132 may be disposed between AC input source and the transformer 134, as depicted in FIG. 12B. In both cases, the current i flows through one or more of the LED groups during operation. The input power generators 120 and 130 may be applied to the drivers of FIGS. 1-9.

It should be understood, of course, that the foregoing relates to exemplary embodiments of the invention and that modifications may be made without departing from the spirit and scope of the invention as set forth in the following claims.

What is claimed is:

1. A driver circuit for driving light emitting diodes (LEDs), comprising:

a string of LEDs divided into n groups, wherein n being a positive integer, the n groups of LEDs being electrically connected to each other in series, a downstream end of group m−1 being electrically connected to the upstream end of group m, where m being a positive number equal to or less than n;

a power source coupled to an upstream end of group 1 and operative to provide an input voltage; and a plurality of current regulating circuits, each of the current regulating circuits being coupled to the downstream end of a corresponding group at one end and coupled to a ground at an other end and including a sensor amplifier and a cascode having first and second transistors, wherein an output pin of the sensor amplifier of the current regulating circuit corresponding to group m−1 is directly connected to a component of the current regulating circuit corresponding to group m.

2. A driver as recited in claim 1, wherein each of the groups includes one or more LEDS and resistors of the same or different kind, color, and value, connected in parallel or in series or combination thereof.

3. A driver as recited in claim 1, wherein the first transistor is an ultra-high-voltage (UHV) transistor and is a N-Channel MOSFET, a P-Channel MOSFET, a NPN bipolar transistor, a PNP bipolar transistor, or an Insulated gate bipolar Transistor (IGBT).

4. A driver as recited in claim 1, wherein the second transistor is a low-voltage, a medium voltage, or a high voltage transistor and is a N-Channel MOSFET, a P-Channel MOSFET, a NPN bipolar transistor, a PNP bipolar transistor, or an Insulated gate bipolar Transistor (IGBT).

5. A driver as recited in claim 1, wherein the component is the sensor amplifier.

6. A driver as recited in claim 1, wherein the sensor amplifier of each of the current regulating circuits is connected to a voltage source for providing a reference voltage thereto and the voltage source includes a reference current source and a resistor.

7. A driver as recited in claim 1, further comprising:

a plurality of resistors, each of the resistors being disposed between a source of the second transistor of a corresponding group and the ground.

8. A driver as recited in claim 1, wherein the power source includes a rectifier and a transformer.

9. A driver as recited in claim 1, wherein the component is a gate of the first transistor.

10. A driver as recited in claim 9, further comprising:

a plurality of switches, each of the switches being adapted to switch between two reference voltages and connected to the sensor amplifier of a corresponding one of current regulating circuits, wherein the output pin of the sensor amplifier of the current regulating circuit corresponding to group m−1 is directly connected to the switch corresponding to group m−2.

11. A driver as recited in claim 1, further comprising an over-voltage detector connected to a downstream end of the string of LEDs.

12. A driver as recited in claim 11, wherein the over-voltage detector includes a Zener diode, a resistor, and a detector adapted to detect a voltage at a point in the resistor.

* * * * *